US007399519B2

(12) United States Patent
Fang et al.

(10) Patent No.: US 7,399,519 B2
(45) **Date of Patent: *Jul. 15, 2008**

(54) TREATED TEXTILES AND COMPOSITIONS FOR TREATING TEXTILES

(75) Inventors: Xinggao Fang, Duncan, SC (US); Sidney S. Locke, Jr., Greer, SC (US); Paul A. Maclure, Landrum, SC (US); Jason G. Chay, Greenville, SC (US); Michelle Purdy, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/685,318

(22) Filed: Oct. 14, 2003

(65) Prior Publication Data

US 2005/0062010 A1 Mar. 24, 2005

Related U.S. Application Data

(60) Provisional application No. 60/504,756, filed on Sep. 22, 2003.

(51) Int. Cl.
*B32B 5/02* (2006.01)

(52) U.S. Cl. ..... 428/196; 428/195.1; 442/64; 442/65; 442/67; 442/69; 442/82; 442/93; 442/94; 442/110; 442/111

(58) Field of Classification Search ..... 442/59, 442/80, 64, 65, 67, 69, 82, 93, 94, 110; 252/8.62; 428/195.1, 196
See application file for complete search history.

(56) References Cited

U.S. PATENT DOCUMENTS

| | | | | | |
|---|---|---|---|---|---|
| 4,411,928 | A | | 10/1983 | Baldwin | 427/2 |
| 4,721,511 | A | | 1/1988 | Kupits | 8/188 |
| 4,822,667 | A | | 4/1989 | Goad et al. | 428/265 |
| 5,035,943 | A | | 7/1991 | Kinlaw et al. | 428/290 |
| 5,156,906 | A | | 10/1992 | Holland | 428/264 |
| 5,244,718 | A | | 9/1993 | Taylor et al. | 428/229 |
| 5,453,540 | A | * | 9/1995 | Dams et al. | 564/96 |
| 5,464,897 | A | * | 11/1995 | Das et al. | 524/458 |
| 5,540,920 | A | | 7/1996 | Vinopal et al. | 424/405 |
| 5,565,265 | A | | 10/1996 | Rubin et al. | 428/265 |
| 5,624,736 | A | | 4/1997 | DeAngelis et al. | 428/196 |
| 5,747,392 | A | | 5/1998 | Xiao et al. | 442/82 |
| 5,756,181 | A | * | 5/1998 | Wang et al. | 428/96 |
| 5,762,650 | A | * | 6/1998 | Ruggiero et al. | 8/490 |
| 5,804,291 | A | * | 9/1998 | Fraser, Jr. | 442/417 |
| 5,899,783 | A | | 5/1999 | Kimbrell, Jr. et al. | 442/62 |
| 5,902,753 | A | | 5/1999 | DeMott et al. | 442/79 |
| 5,968,207 | A | | 10/1999 | Li | 8/490 |
| 6,001,749 | A | | 12/1999 | Child et al. | 442/71 |
| 6,008,236 | A | | 12/1999 | Oppong et al. | 514/345 |
| 6,024,823 | A | | 2/2000 | Rubin et al. | 156/278 |
| 6,165,920 | A | | 12/2000 | Rubin et al. | 442/226 |
| 6,207,250 | B1 | | 3/2001 | Bullock et al. | 428/137 |
| 6,251,210 | B1 | * | 6/2001 | Bullock et al. | 156/272.2 |
| 6,346,491 | B1 | | 2/2002 | DeAngelis et al. | 442/110 |
| 6,451,717 | B1 | * | 9/2002 | Fitzgerald et al. | 442/82 |
| 6,479,144 | B2 | | 11/2002 | Petrea et al. | 428/379 |
| 6,492,001 | B1 | | 12/2002 | Rubin et al. | 428/137 |
| 6,541,138 | B2 | | 4/2003 | Bullock et al. | 428/908.8 |
| 6,610,775 | B1 | * | 8/2003 | Oharu et al. | 524/507 |
| 6,716,481 | B2 | | 4/2004 | DeAngelis et al. | 427/121 |
| 6,720,539 | B2 | | 4/2004 | DeAngelis et al. | 219/545 |
| 6,749,641 | B2 | | 6/2004 | Cates et al. | 8/115.51 |
| 6,818,253 | B2 | | 11/2004 | Kimbrell | 427/393.4 |
| 6,884,491 | B2 | | 4/2005 | Rubin et al. | 428/137 |
| 6,899,923 | B2 | | 5/2005 | Kimbrell, Jr. et al. | 427/381 |
| 6,936,076 | B2 | | 8/2005 | Cates et al. | 8/115.51 |
| 7,012,033 | B2 | | 3/2006 | Hayes et al. | 442/92 |
| 7,037,346 | B2 | | 5/2006 | Cates et al. | 8/115.51 |
| 7,049,557 | B2 | | 5/2006 | DeAngelis et al. | 219/545 |
| 7,064,299 | B2 | | 6/2006 | Green et al. | 219/515 |
| 7,244,371 | B2 | | 7/2007 | Fang et al. | 252/8.62 |
| 2001/0021616 | A1 | | 9/2001 | Bullock et al. | 442/76 |
| 2003/0008585 | A1 | | 1/2003 | Rubin et al. | 442/286 |

(Continued)

FOREIGN PATENT DOCUMENTS

| | | |
|---|---|---|
| WO | WO 91/14512 | 3/1991 |

OTHER PUBLICATIONS

U.S. Appl. No. 11/709,483, Title: "Electocoated Conductive Fabric", filed Feb. 22, 2007, Inventor: DeAngelis et al. (Milliken File 6086).

(Continued)

*Primary Examiner*—Terrel Morris
*Assistant Examiner*—Matthew D Matzek
(74) *Attorney, Agent, or Firm*—Terry T. Moyer; John E. Vick, Jr.

(57) ABSTRACT

Certain chemical compositions provide superior repellency, durability, and soil (stain) release properties when applied to a textile or fabric. Compositions may contain a fluorochemical-containing soil release component or a crosslinking component, or both, and also may contain an antimicrobial agent. In some applications, the crosslinking component may be hydrophobic, so as to be generally not compatible with aqueous environments. Compositions having less than about 6 weight percent of a fluorochemical-containing soil release component, based upon the weight of the treating composition, may be employed in some applications.

9 Claims, No Drawings

U.S. PATENT DOCUMENTS

| | | | | |
|---|---|---|---|---|
| 2003/0139521 | A1* | 7/2003 | Linert et al. | 524/507 |
| 2004/0018787 | A1 | 1/2004 | Bullock et al. | 442/59 |
| 2004/0023578 | A1* | 2/2004 | Sobieski et al. | 442/76 |
| 2004/0053552 | A1 | 3/2004 | Child et al. | 442/110 |
| 2004/0076792 | A1* | 4/2004 | Green et al. | 428/96 |
| 2005/0056805 | A1 | 3/2005 | Fang et al. | 252/8.62 |
| 2005/0062010 | A1 | 3/2005 | Fang et al. | 252/8.62 |
| 2005/0085145 | A1 | 4/2005 | Fang et al. | 442/95 |
| 2005/0272333 | A1 | 12/2005 | Wang et al. | 442/64 |
| 2005/0272334 | A1 | 12/2005 | Wang et al. | 442/93 |
| 2006/0192184 | A1 | 8/2006 | Child et al. | 252/500 |
| 2007/0021019 | A1 | 1/2007 | Rubin et al. | 442/59 |
| 2007/0224898 | A1 | 9/2007 | DeAngelis et al. | 442/79 |

OTHER PUBLICATIONS

U.S. Appl. No. 11/881,439, Title: "Static Dissipative Textile and Method for Producing the Same", filed Jul. 27, 2007, Inventor: Child et al. (Milliken File 5346A).

U.S. Appl. No. 11/977,619, Title: "Treated Textiles", filed Oct. 25, 2007, Inventor: Fang et al. (Milliken File 5682B).

* cited by examiner

TREATED TEXTILES AND COMPOSITIONS FOR TREATING TEXTILES

CROSS REFERENCE TO RELATED APPLICATIONS

This application claims priority to U.S. patent application No. 60/504,756, filed on Sep. 22, 2003.

BACKGROUND OF THE INVENTION

Fluorocarbon stain resistant textile treatments such as Teflon® are used to impart repellent properties to textile surfaces. Such treatments typically provide limited protection against staining of the textile surface. Once oily stains are pressed into the fibrous structure of a repellent fluorocarbon-treated textile surface, such stains generally cannot reliably be removed from the textile surface.

Antimicrobial textile treatment offers added advantage of reducing or eliminating odor and mildew in textiles by limiting the growth of microbes within a textile. Numerous United States Patents have directed efforts toward the application of antimibrobial treatments for textile or fabric substrates, including, for example, U.S. Pat. Nos. 5,968,207; 6,479,144; 6,024,823; 6,492,001 B1; 6,207,250; 5,565,265; and U.S. Published applications 2003/0008585 A1 entitled "Treated Textile Fabric" and 2001/0021616 A1 entitled "Treated Textile Fabric". Many of the textile fabrics disclosed in these references, however, impart no substantive stain release properties, making them difficult to clean.

Stain release refers generally to the ability of a textile or fabric to release a ground in stain, such as an oil-based stain, from the fabric surface. It would be beneficial if a textile was capable of exhibiting stain repellency to liquid spills, but also function well in stain release. Many prior art treated textiles provide protection in terms of repellency, but fail to provide substantial protection as to stain release. A fabric that could provide repellency to liquids, substantive stain release, and also control the growth of microbes, mold, mildew, and the like, would be highly desirable for many textile surfaces.

A recent U.S. patent application publication 2003/0008585 A1 to Rubin et. al. entitled "Treated Textile Fabric" ("Rubin") discloses compositions and a process for preparing a treated textile fabric. In general, the fabric comprises from about 6 weight percent to about 12 weight percent of a fluorochemical textile treating agent, which forms a relatively heavy film on the fabric. However, a textile containing such a relatively large percentage of textile treating agent may be undesirably stiff or have a relatively low degree of hand. Further, such chemicals are costly when applied in such amounts. Using relatively large amounts of such treating agents upon a fabric surface may reduce softness, which is undesirable. Also, such fabrics have poor soil and stain release characteristics.

DETAILED DESCRIPTION OF THE INVENTION

Surprisingly, it has been discovered that certain compositions are capable of affording to a textile surface good liquid repellency, while also imparting substantive stain release. Furthermore, bacterial growth simultaneously may be controlled by the use of antimicrobial components or agents. A crosslinking component may also be employed in the composition, as an optional component. Such treatments provide long lasting effects, that is, textiles so treated are in general durable to normal use, such as wear and tear. The advantageous properties as described will last even after many cleanings and long term uses. Furthermore, it is possible to provide such advantageous effects without forming a heavy film on such textile articles. Many of the applications of the invention (but not all) use less than about 6 weight percent of fluorocarbon as a percentage of the total or primary treatment composition.

Definitions and Terms

"Water repellency" and "oil repellency" are generally defined as the ability of a substrate to block water and oil from penetrating into the substrate, respectively. For example, the substrate may be a textile substrate which is capable of blocking water and oil from penetrating into the fibers of the textile substrate.

"Stain and soil release" generally refers to the degree to which a stained substrate approaches its original, unstained appearance as a result of a care procedure.

The terms "stain or soil resistant composition or stain or soil resistant treatment" as used herein refer to any treatment or composition that imparts stain resistance to fibers, particularly polyester or blends.

"Durability" is generally defined as the ability of a substrate to retain an acceptable level of a desired function through a reasonable number of cleaning or wear cycles. More specifically, durability, as described herein, describes a substrate that maintains adequate properties of stain resistance, water repellency, oil repellency, and soil release over the life of the product. This substrate may be a textile substrate, such as, for example, a polyester textile fabric, or alternatively may be a carpet, or yet another textile material.

The terms "fluorocarbons," "fluoropolymers," and "fluorochemicals" may be used interchangeably herein and each represents a polymeric material containing at least one fluorinated segment.

"Hydrophilic" is defined as having a relatively strong affinity for or ability to absorb water.

"Hydrophobic" is defined as lacking affinity for or the ability to absorb water.

Soil (Stain) Release Component

Soil (or stain) release agents, for example, may include ethoxylated polyesters, fluorinated esters, urethanes, acrylates, sulfonated polyesters, ethoxylated nylons, carboxylated acrylics, cellulose ethers or esters, hydrolyzed polymaleic anhydride polymers, polyvinylalcohol polymers, polyacrylamide polymers, fluorinated stain release polymers, ethoxylated silicone polymers, polyoxyethylene polymers, polyoxyethylene-polyoxypropylene copolymers, and the like, or combinations thereof. Specific commercially available examples of soil release components include, without limitation, Repearl SR-1100® (available from Mitsubishi International Corporation), Bayard SOC™ (Bayer), Zonyl 7910®, 92000 (Ciba Specialty Chemical), Unidyne TG-992®, or TG-993® (Daikin Corporation), and PM 490® (3M Company).

Soil and stain release fluorochemicals may be employed, such as for example, fluorinated esters, urethanes, and (meth) acrylates. Such compositions act as release components. Examples include Repearl SR-1100™ (available from Mitsubishi International Corporation), Bayard SOC™ (from Bayer), Zonyl 7910™, 9200™ (from Ciba Corporation), TG993™ (from Daikin Corporation), FC 248™, and PM 490™ (3M Company).

Antimicrobial Component

The terms "antimicrobial component" or "antimicrobial agent" are intended to encompass any compound which exhibits antimicrobial activity. The antimicrobial agent comprises, in one embodiment of the invention, one or more of the following: silver-containing resins, silver-containing zeolites, silver-containing glass, silver-based ion exchange compounds, inorganic antimicrobial materials, metal based zeolites, metal salts, metal oxides, metal hydroxides, transition metal ions, triclosan, pyrithione and derivatives, tributyl tin oxide derivatives, 3-iodo-2-propylbutyl carbamate, n-butyl-1, 2 benz-iso thiazoline, 10, 10'-oxybisphenoxiarsine, sodium o-phenylphenate, and others, to name only some of the possible choices that may be employed.

In many applications, it will be desirable to employ silver-based ion-exchange compounds, a silver-based zeolite, or a silver-based glass, and any combinations thereof. One silver-based ion exchange material is an antimicrobial silver zirconium phosphate (RC-5000®) available from Milliken & Company, under the tradename ALPHASAN.

Generally, such a metal compound may be added in an amount of from about 0.00001 to 10% by total weight of the particular latex composition; or alternatively from about 0.001 to about 5%; or otherwise, from about 0.01 to about 1%; and also from about 0.1 to about 1.0%.

Antimcrobial agents such as Ultrafresh NM™ and Ultrafresh DM-50™, DM-25™(from Thompson Associates), RC-5000™ (from Milliken Chemical), Chitosante™ (VAG Bioscience, Inc. R.O.C., Taiwan), Kathon LM™ (from Rohm and Haas Company), Zinc Omadine (from Arch Chemical), Reputex 20™ (from Avecia), AM 5700™ (Dow Corning), Amical 48™ (Dow Chemical Co.), also may be employed. In many applications, Zinc Omadine or Sodium Omadine are very effective antimicrobial agents.

Optional Crosslinking Component

Cross-linking components may be employed in the invention, including cross-linking components that are essentially insoluble in water, which also are known as hydrophobic. In other formulations, hydrophilic crosslinkers are useful.

In one embodiment of the invention, the use of crosslinking components comprises of one or more of the following: melamine formaldehydes and derivatives, epoxides, and anhydrides and derivatives thereof.

In other embodiments, hydrophobic cross-linking components may include protected derivatives of isocyanates and the like, or combinations thereof. Protected diisocyanates may be the suitable cross-linking components. Monomers or polymers containing two or more blocked isocyanate compounds may be the most preferred cross-linking components. One useful cross-linking component is REPEARL® MF™, also available from Mitsubishi Corp. Others include ARKOPHOB® DAN, available from Clariant, and HYDROPHOBOL® XAN™, available from DuPont.

Optional Repellent Components

There are numerous compositions that may be adapted to serve as the repellent component in the present invention. One that is particularly useful is a fluorochemical composition. Numerous fluorochemical compositions are known to be capable of achieving repellency on a fibrous substrate. The 3M Company produces a product line of fluorochemical compositions, including Scotchgard™ and the like, that can be employed. Furthermore, DuPont's Zonyl™ product line is also a candidate for the repellency component of the invention. Other products distributed by Daikin America, Inc. and Mitsubishi International Corporation, each of Japan could be employed, as well as others. REPEARL® F-8025, manufactured by Mitsubishi International Corporation may be used as well. Fluoroacrylates and urethane derivatives may be employed. Esters, (meth)acrylic amides oligomers and polymers also may be employed.

Optional Generation of a Static Dissipative Fabric or Textile

One particular embodiment of the invention may employ materials necessary to make a static dissipative textile having an electrically conductive surface. This may be achieved by first applying a fluorochemical, an antimicrobial agent, (separately or together, in any order) and optionally a crosslinker or repellent, followed by the application of a static dissipative material. The electrically conductive surface may be achieved by screen printing the fabric with an electrically conductive coating, wherein the conductive coating includes a conducting agent and a binding agent, and optionally a dispersing agent and/or a thickening agent. The fabric may be coated in any pattern which achieves the desired static dissipative property for the fabric end-use. The fabric may be coated on one side as determined generally by the end-use of the fabric by considering the desired appearance of the coated fabric or the conductive performance of the coated fabric. The resulting electrically conductive fabric may be suitable in end-use applications such as automotive upholstery and other automotive interior fabrics, such as door panels, armrests, headrests, commercial and/or residential upholstery; cleanroom garments, wipes and/or other cleanroom accessories such as mops, napery, and apparel.

In one embodiment of the invention, it may be possible to achieve a composite material, wherein a static dissipative textile may further comprise at least one layer of a second fabric disposed adjacent to the electrically conductive coating. The second fabric may be woven, knitted, or nonwoven fabric. Alternatively, the static dissipative textile may further comprise at least one layer of foam material disposed adjacent to the electrically conductive coating. The composite material may further include one or more layers of woven, knitted, or nonwoven fabric; one or more layers of film; one or more layers of adhesive; and combinations thereof.

The composite material may be used, for example, in automobile interiors, such as in automotive upholstery, wherein the upholstery fabric is adhered to a foam backing through the use of adhesive, heat lamination, or the like. The composite material may be applicable for use in other areas such as, for example, in residential or commercial upholstery or in carpeting.

It is also an object of the current invention to achieve a method for producing a static dissipative textile having an electrically conductive surface. The method generally comprises the steps of providing a knitted, woven, or nonwoven fabric, coating one or both sides of the fabric with an electrically conductive coating in a pattern comprised of lines, and drying the fabric. The antistatic component may comprise a graphite-containing material. The fabric may then be exposed to one or more mechanical and/or chemical textile finishing processes known to those skilled in the art.

A static dissipative textile is provided which has relatively permanent anti-static properties which are achieved at substantially all relative humidities without significantly compromising the textile hand (or feel) of the textile or the surface appearance of the textile. The static dissipative textile generally comprises a fabric coated on the backside, —with a pattern of an electrically conductive coating.

Textile Substrates

Textiles substrates employed in the practice of the invention which are to be treated may be synthetic, natural, and/or blends. They can be woven, knit, carpet or nonwoven. The composition(s) may be applied to textile substrates by generally known methods such as immersion, foam, spray, exhaustion, and coating. Such compositions can be applied to either side or both sides of the textile substrates. Such compositions could also have one or more components applied to the substrate, followed by other or all components. In addition, such compositions could have one or more components applied to one side of the substrates, and other or all components applied to either side of the substrates.

The fabric of the current invention can be formed from fibers such as synthetic fibers, natural fibers, or combinations thereof. Synthetic fibers include, for example, polyester, acrylic, polyamide, polyolefin, polyaramid, polyurethane, regenerated cellulose, and blends thereof. More specifically, polyester includes, for example, polyethylene terephthalate, polytriphenylene terephthalate, polybutylene terephthalate, polylatic acid, and combinations thereof. Polyamide includes, for example, nylon 6, nylon 6,6, and combinations thereof. Polyolefin includes, for example, polypropylene, polyethylene, and combinations thereof. Polyaramid includes, for example, poly-p-phenyleneteraphthalamid (i.e., Kevlar®), poly-m-phenyleneteraphthalamid (i.e., Nomex®), and combinations thereof. Natural fibers include, for example, wool, cotton, flax, and blends thereof.

The fabric can be formed from fibers or yarns of any size, including microdenier fibers and yarns (fibers or yarns having less than one denier per filament). Furthermore, the fabric may be partially or wholly comprised of multi-component or bi-component fibers or yarns which may be splittable along their length by chemical or mechanical action. The fabric may be comprised of fibers such as staple fiber, filament fiber, spun fiber, or combinations thereof.

Additional textile treatments can be applied together or separately on either side of textile substrates. Examples include durable press resins and catalysts, sewing lubricants, softeners, antistatic treatments, flame-retardants, and light stabilizers.

Test Methods

Liquid or stain resistant properties may be measured using water and oil repellency tests.

a) Water Repellency may be tested according to the 3M Water Repellency Test II (May, 1992). The rating scale is 1-10, with "1" indicating the poorest degree of repellency (substrates having higher surface energy) and "10" indicating the best degree of repellency (substrates having lower surface energy). The 3M water repellency scale is:
   1 is 10% IPA, 90% water
   2 is 20% IPA, 80% water
   3 is 30% IPA, 70% water
   4 is 40% IPA, 60% water
   5 is 50% IPA, 50% water
   6 is 60% IPA, 40% water
   7 is 70% IPA, 30% water
   8 is 80% IPA, 20% water
   9 is 90% IPA, 10% water
   10 is 100% IPA b) Oil Repellency may be tested according to the AATCC Test Method 118-1983. The rating scale is 1-8, with "1" indicating the poorest degree of repellency (substrates having higher surface energy) and "8" indicating the best degree of repellency (substrates having lower surface energy). The oil repellency scale is:
   1 is NUjOl™ Mineral Oil
   2 is 65/35 Nujol/n-hexadecane (by volume)
   3 is n-hexadecane
   4 is n-tetradecane
   5 is n-dodecane
   6 is n-decane
   7 is n-octane
   8 is n-heptane c) Stain release properties may be measured by using a spot cleaning procedure. Oily stains such as corn oil and tanning oil were pressed into the textile substrate using the staining procedure described in AATCC Test Method 130-1981; as modified herein. The stained textile was left at room temperature for 24 hours. A piece of paper towel was used to wipe off excess stains at the surface of the texitle. Then 4 drops of fabric cleaner (such as Zout) were gently worked into the stained area. The textile was left for 5 minutes at room temperature. Finally the stained areas were scrubbed with approximate 4" by 4" polycotton cloths for about 40 seconds and then rinsed with generous amount of warm water. Excess water was blotted off with a paper towel. After the cleaned textile was air dried at room temperature, stain release performance was rated against the rating replica of AATCC 130-1981 with a rating scale from 1 to 5 with 5 to be the best.

Generally a rating of 3.5 and above is considered to have good soil/stain release property.

Antimicrobial Testing

Antimicrobial properties (bacteria and fungi) may be tested using modified AATCC Method 147, also known as the Parallel Streak Method, as further defined below.

In the Parallel Streak Method, an agar surface is inoculated, thereby making it easier to distinguish between the test organism and contaminant organisms that may be present on the unsterilized specimen. The Parallel Streak Method has proven effective in providing evidence of antibacterial activity against Gram positive and Gram negative bacteria.

A Zone of Inhibition (millimeters) and growth under the fabric were used to gauge antimicrobial properties of the textile substrates. Generally no growth under the substrate and/or a clear zone of inhibition (ZOI) around the substrates indicates good antimicrobial properties.

Zone of Inhibition

Migration of the antimicrobial was assessed with the Zone of Inhibition assay. Petri plates containing Tryptic Soy Agar were inoculated with 0.5 ml of a diluted overnight culture approximately 5E5 cells/ml in Na/K phosphate buffer of the test microbe. Samples were tested against *Klebsiella pneumoniae* ATCC No. 4362 and *Staphylococcus aureus* ATCC No. 6538, and *A. niger* (a fungus). A sample approximately 1×1 inch is placed in the center of the plate. The agar plate was incubated for 24 hours at 35° C. The final data is the average of the inhibition zone measured on four sides of the sample and description of the degree of growth underneath the sample.

Efficacy was assessed with a Zone of Inhibition assay against *Aspergillus niger* ATCC #6275. Petri plates containing Sabouraud Dextrose Agar were inoculated with 0.5 ml of 1 E5 fungal spores/ml. A sample approximately 1×1 inch is placed in the center of the plate. The agar plate was incubated for 1-7 days at 250 C. The final data is the average of the inhibition zone measured on four sides of the sample and description of the degree of growth underneath the sample.

Chemical Concentration

In the practice of the invention, the percentage of fluorochemical-containing component in the overall treating composition is typically less than about 6 percent by weight of the treating composition, and commonly between about 0.5% and about 3 percent by weight of treating composition. In one particular embodiment, the percentage is about 1-2 percent by weight.

With regard to the percentage of pickup in the application of the invention, the pickup usually is between about 50 and about 70 percent pickup of the fluorocarbon component, but it is certainly possible to employ the invention at a pickup percentage that is outside of that range.

INVENTION

EXAMPLE 1

A piece of woven polyester fabric was immersed in an aqueous bath that contained, on weight basis:

2.0% Unidyne TG-993, 0.25% Arkophob DAN, and 1.0% RC5000

The fabric was passed through a nip with 40 psi pressure to remove excess of moisture. Then the fabric was dried completely in a typical dispatch oven at 360 degrees Fahrenheit for approximate 4 minutes. The fabric was cooled and subject to water and oil resistance and stain release tests as specified above.

The percentage of wet pickup employed was between about 50-70 percent, so that the actual weight of the flurocarbon-containing component was about 1-1.4 percent by weight of the treating composition.

INVENTION

EXAMPLE 2

This example was prepared as in Example 1, except that 1.0% of Zinc Omadine fps dispersion (from Arch Chemical) was used in place of the RC5000.

INVENTION

EXAMPLE 3

This example was prepared as in Example 1 except that the chemical bath contained:

1.25% Unidyne TG-993, 1.0% Repearl F8025

1.0% of Zinc Omadine fps dispersion, and 0.25% of Arkophob DAN.

INVENTION

EXAMPLE 4

This example was prepared as in Example 3 except that no Arkophob® DAN was used.

INVENTION

EXAMPLE 5

This example was prepared as in Example 4 except that the chemical bath contained:

1.25% Unidyne TG-992, 1.0% Repearl F7105, and 1.0% Zinc Omadine fps dispersion.

COMPARATIVE

EXAMPLE 6

Same as example 1 except that neither hydrophobic crosslinker Arkophob® DAN nor antimicrobial agent RC5000 was used.

COMPARATIVE

EXAMPLE 7

The same procedure and materials were employed as in example 1 except that no RC5000 was used.

COMPARATIVE

EXAMPLE 8

Same as Example 1 except that Repearl F8025 was used in place of Unidyne TG-993.

EXAMPLE 9

PRIOR ART

The fabric is Crypton™ 404 obtained from C.F. Stinson and Company of Rochester Hills, Mich. (a distributor of Hi-Tex Crypton brand textiles). This is a commercial product based upon the teachings of U.S. Pat. Nos. 6,024,823, 6,492,001 B1, and 5,565,265 to Rubin et al.

EXAMPLE 10

PRIOR ART

Same as Example 10 except that Crypton™ 61238 from C.F. Stinson was used instead of Crypton™ 404.

EXAMPLE 11

CONTROL

This example used a textile treated only with water, to test the baseline antimicrobial activity.

TABLE 1

| | Results | | | | | | | | | | |
|---|---|---|---|---|---|---|---|---|---|---|---|
| | Examples | | | | | | | | | | |
| | Ex. 1 | Ex. 2 | Ex. 3 | Ex.4 | Ex. 5 | Ex. 6 | Ex. 7 | Ex. 8 | Ex. 9 | Ex. 10 | Ex. 11 |
| Oil Repellence | 6 | 6 | 6 | 6 | 6 | 6 | 6 | 7 | 6 | 2 | X |
| Water repellence | 3 | 3 | 8 | 5 | 4 | 0* | 3 | 10 | 9 | 6 | X |
| Corn oil release | 4.5 | 5.0 | 4.5 | 4.5 | 4.5 | 5.0 | 5.0 | 4.5 | 2.0 | 2.0 | X |
| Tanning oil release | 4.5 | 4.5 | 4.5 | 3.5 | 3.5 | 5.0 | 4.5 | 1.0 | 1.0 | 1.0 | 1.0 |
| | Inhibition (mm)//Growth Under (yes/no) | | | | | | | | | | |
| *S. aureus* | 0//no | 4.3//no | 0.5//no | 6.5//no | 2.6//no | 0/yes | 0//yes | 0//yes | 0//yes | 3//no | 0//yes |
| *K. pneumoniae* | 1.8//no | 8.3//no | 3.8//no | 7.8//no | 5.8//no | 0//yes | 0//yes | 0//yes | 0//yes | 1//no | 0//yes |
| *A. niger* | 0//yes | 0//no | 0//no | 5.8//no | 2//no | 0//yes | 0//yes | 0//yes | 0//yes | x | 0//yes |

Note.
*failed to repel water.

More inventive examples are disclosed below with results listed in Table 2. These examples demonstrate that various other compositions and ratios of chemical compositions could afford equally good repellency and release features to the treated textiles.

INVENTION

EXAMPLE 12

An example was prepared as in example 1 except that the chemical bath comprised:

2.0% Unidyne TG-993, 1.0% Arkophob DAN, and 0.23% RC5000.

The wet pickup was adjusted to 65%.

INVENTION

EXAMPLE 13

The example was prepared as in example 12 except that 0.48% Zinc Omadine was used in place of RC5000 as the antimicrobial component/agent.

COMPARATIVE

EXAMPLE 14

The example was prepared as in example 12 except that 2.0% Repearl F7105 was used in place of Unidyne TG-993.

COMPARATIVE

EXAMPLE 15

The example was prepared as in example 12 except that the chemical bath contained the following:

10.0% Zonyl 7040, 0.25% Aerotex M3, and 0.60% Ultrafresh DM-25.

TABLE 2

| | Results | | | |
|---|---|---|---|---|
| | Examples | | | |
| | Ex. 12 | Ex. 13 | Ex. 14 | Ex. 15 |
| Oil Repellence | 7 | 6 | 6 | 7 |
| Water repellence | 5 | 3 | 10 | 10 |
| Corn oil release | 4.0 | 4.0 | 2.0 | 1.5 |
| Burned motor oil release | 4.0 | 4.0 | 2.0 | 1.0 |
| | Inhibition (mm)//Growth Under (yes/no) | | | |
| *S. aureus* | 0//no | 8.8//no | 0//yes | 0//yes |
| *K. pneumoniae* | 0//no | 10.3//no | 0//yes | 0//yes |

ABRASION TESTING

Fabrics from examples 12 to 17, as indicated below, were abraded 5000 cycles using a Martindale abrasion Tester by ASTM D 4966-98@12 kpa. Repellency and release properties were measured again in the same manner as un-abraded samples. Results are listed in Table 2A, below.

TABLE 2A

| | After Abrasion Results | | | |
|---|---|---|---|---|
| | Examples | | | |
| | Ex. 12 | Ex. 13 | Ex. 14 | Ex. 15 |
| Oil Repellence | 4 | 3 | 2 | 4 |
| Water Repellence | 2 | 2 | 4 | 7 |
| Corn oil release | 5.0 | 4.5 | 3.5 | 1.5 |
| Burned motor oil release | 4.5 | 4.0 | 2.0 | 1.5 |

It was found that the compositions of the invention when applied to a textile result in better repellency at lower concentrations on the fabric. Lesser amounts of treating agent than that which is known in the art may be used in the practice of the invention. Further, superior soil release can be obtained by employing compositions of the invention. Less fluorocarbon-containing material was required in the practice of the invention, as compared to prior art compositions.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A textile comprising a fibrous treated textile substrate having a first fiber-containing side adapted for user contact and a second side opposite the first side, said treated textile substrate further comprising:

(a) a fluorochemical composition applied to at least the first side, said fluorochemical composition being adapted for providing repellency to the first side of the treated fibrous textile substrate, (b) an antimicrobial agent, the antimicrobial agent being present on at least the first side of the treated textile substrate, and (c) an electrically conductive coating layer, the conductive coating layer being present upon only the second side of the treated textile substrate, the conductive coating layer further comprising a conducting agent and a binding agent, the conducting agent being applied upon the coating in a pattern adapted for conducting electrical charge.

2. The textile of claim 1 wherein said fluorochemical composition comprises a polymeric material selected from the group of:

acrylate-containing polymers, methacrylate-containing polymers, urethane-containing polymers, and fluorinated esters.

3. The textile of claim 1 wherein said antimicrobial agent comprises an agent selected from the group consisting of:

organic antimicrobial agents, silver-containing resins, silver-containing zeolites, silver-containing glass, silver-based ion exchange compounds, triclosan, inorganic antimicrobial materials, metal based zeolites, metal salts, metal oxides, metal hydroxides, transition metal ions, zinc oxide, pyrithione and derivatives, zinc pyrithione, tributyl tin oxide derivatives, 3-iodo-2-propylbutyl carbamate, n-butyl-1, 2 benziso thiazoline, 10, 10'-oxybisphenoxiarsine, and sodium o-phenylphenate.

4. The textile of claim 3 wherein said antimicrobial agent comprises silver zirconium phosphate.

5. The textile of claim 1 further comprising a crosslinking component.

6. The textile of claim 1 wherein said electrically conductive coating is applied to said textile by screen printing.

7. The textile of claim 1 wherein said conducting agent is provided in a pattern of conductive lines upon the conductive coating layer, said lines being effective in conducting static charge.

8. The textile of claim 1 wherein said textile is an automotive interior fabric.

9. The textile of claim 1 wherein said electrically conductive coating comprises a graphite-containing material.

* * * * *